United States Patent [19]

Tsubuko et al.

[11] Patent Number: 4,925,763

[45] Date of Patent: May 15, 1990

[54] DEVELOPER FOR ELECTROPHOTOGRAPHY CONTAINING IONOMER RESIN

[75] Inventors: Kazuo Tsubuko; Shinichi Kuramoto, both of Numazu; Kiyoshi Sakai, Mishima, all of Japan

[73] Assignee: Ricoh Company, Ltd., Tokyo, Japan

[21] Appl. No.: 166,878

[22] Filed: Mar. 11, 1988

[30] Foreign Application Priority Data

Mar. 13, 1987 [JP] Japan ..... 62-058202

[51] Int. Cl.[5] ..... G03G 9/08

[52] U.S. Cl. ..... 430/106; 430/107; 430/137

[58] Field of Search ..... 430/106, 107, 110

[56] References Cited

U.S. PATENT DOCUMENTS

| | | | |
|---|---|---|---|
| 3,264,272 | 8/1966 | Rees | 428/36 |
| 4,075,391 | 8/1978 | Berg et al. | 430/108 |
| 4,780,389 | 10/1988 | El-Sayed | 430/115 |
| 4,794,066 | 12/1988 | Taggi et al. | 430/137 |

*Primary Examiner*—John L. Goodrow

*Attorney, Agent, or Firm*—Flynn, Thiel, Boutell & Tanis

[57] ABSTRACT

A developer for electrophotography is disclosed, which comprises toner particles containing therein at least an ionomer resin, which toner particles may comprise a colorant which is prepared by a flushing method by using a pigment component and an ionomer resin, when necessary, with addition thereto a humic acid component selected from the group consisting of humic acid, a salt of humic acid, and a humic acid derivative.

12 Claims, No Drawings

DEVELOPER FOR ELECTROPHOTOGRAPHY CONTAINING IONOMER RESIN

BACKGROUND OF THE INVENTION

The present invention relates to a dry-type developer and a wet-type developer for use in electrophotography, which are capable of yielding improved image density, resolution, and image fixing property, without a strike-through phenomenon that developed images on one side of the copy sheet are visible from the other side (hereinafter this phenomenon is referred to as the strike-through phenomenon).

As a developer for use in electrophotography, a toner comprising polyethylene wax as a binder agent and an organic or inorganic pigment, such as carbon black and phthalo-cyanine blue, which is dispersed in the binder agent, is conventionally known. The toner particles of such a toner containing polyethylene wax have the advantage over other toner particles that a higher image density can be obtained. However, the toner particles have the shortcoming that the images are depressed and defaced in the course of the image transfer process in a copying machine, which degrades the image quality, in particular, image resolution.

A trial has been carried out to prevent the decrease of the sharpness of image and resolution by using an oxidized polyethylene wax instead of polyethylene wax as proposed in Japanese Laid-Open Patent Application No. 54-97157. However, when oxidized polyethylene wax is employed, there is a problem that high image density cannot be increased any further.

In a wet-type toner, low-molecular weight polyolefins having a molecular weight of 3,000 or less are in general use. However, the melting viscosity of such low-molecular weight polyolefins is so low that the previously mentioned strike-through phenomenon occurs when the heat (150° C. to 250° C.) is applied in the course of the image development, transfer and fixing process, so that the above polyolefins are totally unsuitable for duplex copying. Furthermore the image fixing property thereof is so poor that developed images can be readily erased by an eraser.

In addition to the above-mentioned polyethylene wax and oxidized polyethylene wax, polyolefins, polystyrene resin, acrylic resin, epoxy resin, polyester resin, polyolefin resin, and rubber are employed as binder agents for the conventional toners. However these resins also have the same or similar shortcomings as mentioned above more or less.

SUMMARY OF THE INVENTION

It is therefore an object of the present invention to provide a developer for electrophotography from which the conventional shortcomings have been eliminated, and which is capable of yielding high quality images.

Another object of the present invention is to provide a developer (toner) which can be used in both a dry-type electrophotographic development and a wet-type electrophotographic development.

The above objects of the present invention can be achieved by a developer which comprises toner particles containing therein at least an ionomer resin, which toner particles may comprise a colorant which is prepared by a flushing method by using a pigment component and an ionomer resin, when necessary, with addition thereto a humic acid component selected from the group consisting of humic acid, a salt of humic acid, and humic acid derivative.

DETAILED DESCRIPTION OF THE PREFERRED EMBODIMENTS

Ionomer resins for use in the present invention are ionomer resins comprised by a polyolefin main backbone chain to which polar groups, such as a carboxyl group, a hydroxyl group, a glycidyl group, and an amino group are attached, with the molecules thereof being bridged, for example, through part of carboxyl groups with metal ions.

Since the ionomer resins have the above-mentioned structure, when the resins are used together with a pigment to form toner particles, the toner particles exhibit thermoplasticity in a state where the toner particles are dispersed in a solvent or carrier liquid, or upon the toner particles used as dry-type toner particles or wet-type toner particles entering an image fixing process. Furthermore, the fixing performance of the toner particles increases as the fused toner particles are cooled and become hard, because of the intensified ionic bond.

Moreover, since the surface of the toner particles is covered with the polymer having the above-mentioned polar groups, the toner particles are excellent in the development performance and image transfer performance. Therefore high image density and improved image resolution can be obtained by the toner particles.

The developer according to the present invention may be either a liquid developer or a dry-type developer. In the case where the developer is a dry-type developer, it may be either a one-component type developer or a two-component type developer.

A liquid developer (or toner) according to the present invention can be prepared by dispersing 1 part by weight of a pigment and 0.1 to 20 parts by weight of the ionomer resin, more preferably 1 to 10 parts by weight of the ionomer resin, in 10 to 100 parts by weight of a dispersing medium (preferably the same dispersing medium as a carrier liquid of the developer) in a dispersion mixer, such as ball mill, Keddy mill, and attritor, to form a concentrate liquid developer, and then diluting the concentrate liquid developer with the carrier liquid.

When necessary, a thermoplastic resin and a charge controlling agent may be added to the above liquid developer in the course of the production thereof.

A dry-type developer (or toner) according to the present invention can be prepared by kneading a mixture of 1 part by weight of a colorant and 0.1 to 20 parts by weight of the ionomer resin by a heat roller, cooling the kneaded mixture, grinding the mixture to finely-divided particles and classifying the particles.

When necessary, a styrene-acryl copolymer resin, rosin-modified resin, silicon oxide, and a charge controlling agent may be added to the above dry-type developer (or toner).

The inventors of the present invention have confirmed that a better developer can be obtained by further addition of humic acid, salts of humic acid and/or humic acid derivatives (hereinafter collectively referred to as the humic acid component) to the components of the developer according to the present invention. This advantage is considered to be obtained because when the humic acid component is added to the components of the developer together with the ionomer resin, not only the dispersibility of the pigment contained in the developer (both the wet-type developer and dry-type developer), but also the dispersibility of the colorant itself are improved because of the excellent compatibility of the humic acid component with other resin components and the high melting viscosity thereof. Thus, the blending of the developer with other resins can also be facilitated.

Another advantage obtained by use of the humic acid component in combination with the ionomer resin is more apparent when the developer according to the present invention is compared with a conventional liquid developer which is prepared by kneading a resin other than the above-mentioned ionomer resin and an inorganic or organic pigment such as carbon black and phthalocyanine blue, grinding the kneaded mixture to prepare a colorant, which is used as toner particles, and then uniformly dispersing the toner particles in a high electric insulating carrier liquid having a low dielectric constant.

In such a conventional colorant, the primary particles of the organic or inorganic pigment particles aggregate so strongly that they cannot be easily dispersed to the extent that those particles turn out to be of the primary particle size even if they are dispersed in a vehicle in a ball mill, in an attritor or in a heat roll mill.

The ionomer resins (polymers of an organic component and an inorganic component in which the linkages thereof are ionic as well as covalent bonds) have, for example, the following formula:

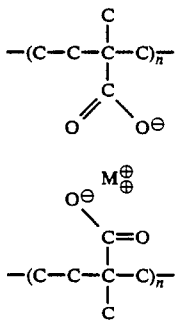

Wherein M represents a monovalent or divalent metallic element.

Specific examples of the ionomer resins are:

(1) Ethylene-methacrylic acid ionomer resin (mole ratio 90:10, metal: Na)

(2) Ethylene-methyl methacrylate-methacrylic acid ionomer resin (mole ratio 70:10:20, metal: Zn)

(3) Propylene-acrylic acid-diethylaminoethyl methacrylate ionomer resin (mole ratio 70:25:5, metal: Mg)

(4) Propylene-isobutyl methacrylate-glycidyl methacrylate-maleic acid ionomer resin (mole ratio 50:20:15:15, metal: Fe)

(5) Ethylene-propylene-lauryl methacrylate-acrylic acid ionomer resin (mole ratio 30:30:20:20, metal: Zr or Ca).

Examples of commercially available ionomer resins are Himilan 1554, 1555, 1557, 1601, 1605, 1650, 1652, 1652SR, 1652SB, 1702, 1705, 1706, 1707, 1855, and 1856 (made by Du Pont-Mitsui Polychemicals Co., Ltd.). Of these ionomer resins, ion-type resins comprise any of the metal ions of Zn, Na, K, Fe, Al, Co, Zr, Ca, Mg, Ni, and Sn.

Examples of carbon black that can be employed as a pigment component in the colorant in the present invention are furnace black, acetylene black, channel black, commercially available carbon black such as Printex G, Special Black 15, Special Black 4 and Special Black 4-B (made by Degussa Japan Co., Ltd), Mitsubishi #44, #30, MA-11 and MA-100 (made by Mitsubishi Carbon Co.), Raben 30, Raben 40 and Conductex SC (made by Columbia Carbon Co.), Regal 800, 400, 660 and Blackpearls L (made by Cabot Corp.).

Examples of organic pigments that can be employed as another pigment component in the colorant in the present invention are Phthalocyanine Blue, Phthalocyanine Green, Sky Blue, Rhodamine Lake, Malachite Green Lake, Methyl Violet Lake, Peacock Blue Lake, Naphthol Green B, Naphthol Green Y, Naphthol Yellow S, Lithol Fast Yellow 2G, Permanent Red 4R, Brilliant Fast Scarlet, Hansa Yellow, Benzidine Yellow, Lithol Red, Lake Red C, Lake Red D, Brilliant Carmine 6B, Permanent Red F5R, Pigment Scarlet 3B and Bordeaux 10B.

In the present invention, part of the ionomer resins can be replaced by any of the following resins within the scope of the present invention: Natural-resin-modified phenolic resin, Natural-resin-modified maleic acid resin, dammar, copal, shellac, gum rosin, hardening rosin, ester-gum-glycerin-ester-modified maleic acid resin, styrene-butadiene copolymer, ethylene-vinyl acetate copolymer, polyolefins, polyolefin copolymer, and wax.

Specific examples of commercially available resins other than the ionomer resins, including waxes, are as follows:

| Manufacturer | Trademark | Softening Point (°C.) |
|---|---|---|
| Union Carbide Corp. (U.S.A.) | DYNI | 102 |
| | DYNF | 102 |
| | DYNH | 102 |
| | DYNJ | 102 |
| | DYNK | 102 |
| Monsanto Co. (U.S.A) | Orlizon 805 | 116 |
| | Orlizon 705 | 116 |
| | Orlizon 50 | 126 |
| Philips Petroleum Co. (U.S.A.) | Marlex 1005 | 92 |
| Du Pont de Nemours, E.I. & Co. | Alathon 3 | 103 |
| | Alathon 10 | 96 |
| | Alathon 12 | 84 |
| | Alathon 14 | 80 |
| | Alathon 16 | 95 |
| | Alathon 20 | 86 |
| | Alathon 22 | 84 |
| | Alathon 25 | 96 |
| Allied Chemical Corp. (U.S.A.) | AC Polyethylene 1702 | 85 |
| | AC Polyethylene 617, 617A | 102 |
| | AC Polyethylene 9, 9A | 117 |
| | AC Polyethylene 430 | 60 |
| | AC Polyethylene 405 | 96 |
| | AC Polyethylene 401 | 102 |
| | AC Polyethylene 540 | 108 |
| | AC Polyethylene 580 | 108 |
| Mitsubishi Rayon Co., Ltd. | BR-50 | 100 |
| | BR-80 | 105 |
| | BR-90 | 65 |
| | BR-95 | 80 |
| | BR-101 | 50 |
| | BR-102 | 20 |
| | BR-107 | 50 |
| Nihon Gas Chemical | Nikanol HP-70 | 70~90 |
| | Nikanol HP-100 | 105~125 |
| | Nikanol HP-120 | 125~145 |
| | Nikanol A-70 | 7~90 |
| | Nikanol A-100 | 110~130 |
| | Nikanol A-120 | 120~140 |
| Kodak Japan K.K. | Epolene N-14 | 105 |
| | Epolene E-15 | 96 |
| Sanyo Chemical Industries, Ltd. | Sanwax 131-P | 108 |
| | Sanwax 151-P | 107 |

-continued

| Manufacturer | Trademark | Softening Point (°C.) |
|---|---|---|
| | Sanwax 161-P | 111 |
| | Sanwax 165-P | 107 |
| | Sanwax 171-P | 105 |
| | Sanwax E-200 | 95 |
| | Sanwax E-300 | 98 |
| | Viscol 330-P | 152 |
| | Viscol 550-P | 150 |
| | Viscol 660-P | 145 |
| | Viscol TS-200 | 145 |
| Quaker State Oil | QS-Wax | 65 |
| Junsei Chemical Co., Ltd. | Paraffin Wax | 60~90 |
| Hoechst A.G. (West Germany) | PED 521 | 104 |
| | PED 543 | 110 |
| | PED 153 | 99 |

Of the resins other than the ionomer resins, ethylene-vinyl acetate copolymer (vinyl acetate content: 1.0~50 wt %, preferably 10~40 wt %, softening point: 40°~180° C., preferably 60°~120° C.) is preferable for use. Typical examples of such an ethylene-vinyl acetate copolymer now on the market are as follows:

(1) Examples made by Du Pont-Mitsui Polychemicals Co., Ltd.

| Trademark | Vinyl Acetate Content (wt. %) | Softening Point (°C.) |
|---|---|---|
| Evaflex 45 | 46 | 94 |
| 40 | 41 | 98 |
| 150 | 33 | 120 |
| 210 | 28 | 85 |
| 220 | 28 | 90 |
| 250 | 28 | 135 |
| 260 | 28 | 155 |
| 310 | 25 | 90 |
| 360 | 25 | 185 |
| 410 | 19 | 90 |
| 420 | 19 | 100 |
| 450 | 19 | 135 |
| 560 | 14 | 170 |
| P-1403 | 14 | 70 |
| P-1207 | 12 | 70 |
| P-0607 | 6 | 72 |

(2) Examples made by TOSOH Corporation

| Trademark | Vinyl Acetate Content (wt. %) | Softening Point (C.) |
|---|---|---|
| ULTRATHENE 631 UE | 20 | 92 |
| 634 | 26 | 81 |
| 630 | 15 | 97 |

(3) Examples made by Allied Chemical Corp.

| Trademark | Vinyl Acetate Content (wt. %) | Softening Point (C.) |
|---|---|---|
| 400 & 400A | 14 | 95 |
| 402 & 402A | 2 | 102 |
| 403 & 403A | 2 | 106 |
| 405 | 11 | 96 |
| 430 | 26 | 60 |

(4) Examples made by Hoechst Japan Limited

| Trademark | Vinyl Acetate Content (wt. %) | Softening Point (C.) |
|---|---|---|
| TMREV720 | 25 | 102 |

(5) Examples made by BASF

| Trademark | Vinyl Acetate Content (wt. %) | Softening Point (C.) |
|---|---|---|
| SC9626 | 6~9 | 88~91 |

Humic acid, salts of humic acid and humic acid derivatives, which are collectively referred to as the humic acid component, will now be explained. The humic acid component is an alkali-soluble, amorphous, polymeric organic acid constituent of young coals such as peat and lignite in a low rank of coalification. The humic acid component is classified into a natural humic acid component and a synthetic humic acid component, both of which contain nitrohumic acid.

In the present invention, both the natural humic acid component and the synthetic humic acid component can be employed. There are three types of humic acid components for industrial use, that is, CH type, CHA type and CHN type, depending upon the molecular weight distribution, and each type has two sub-types, an acid-type, and a salt type (such as Na and $NH_4$ salts). All of these can be employed in the present invention.

The humic acid component is so well adsorbed by pigments that it is very advantageous to use the humic acid component for dispersing pigments finely to nearly primary particles, or for attaining good stability of the dispersion and accordingly for obtaining long shelf life of the developer.

The developer toner particles according to the present invention comprises a colorant in the form of the particles of a pigment which are overcoated with the ionomer resin. This colorant may be prepared by a flushing method, with either a formulation (a) of a pigment and the ionomer resin, or a formulation (b) of a pigment, the ionomer resin, and a humic acid component.

More specifically, the above colorant is prepared as follows:

An aqueous dispersion of a pigment, free from the humic acid component, is added to an ionomer resin solution to form a mixed dispersion.

Alternatively, the humic acid component is added to the above-mentioned aqueous dispersion of a pigment in an amount of 0.1~30 wt. %. To this mixture, the above solution of the ionomer resin is added to form a mixed dispersion.

Any of the above mixed dispersions is sufficiently kneaded in a kneader called a "flusher", thus the water which covers each pigment particle is replaced by the ionomer resin solution. The water in the kneader is discarded, whereby a dispersion of the pigment particles dispersed in the resin solution is obtained.

This dispersion is dried and then the solvent is removed therefrom. As a result, a solid mass is obtained. The resulting solid mass is then pulverized, whereby a powder-like colorant is obtained.

This colorant consists of the pigment particles coated with the ionomer resin, each particle being in the state of primary particle. This colorant is useful not only as a toner for electrophotography, but also as a colorant for use in printing inks and paints.

A liquid developer according to the present invention can be prepared by dispersing finely-divided colorant particles in a carrier liquid. As the carrier liquid, for instance, the following can be employed: petroleum-type aliphatic hydrocarbon with high electric insulating properties (for instance, with the electric resistivity thereof being $10^{10}$ Ωcm or more) and with a low dielectric constant (for instance, with the dielectric constant thereof being 3 or less), n-hexane, ligroin, such as n-heptane, n-pentane, isodecane, isooctane, and halogenated derivatives thereof, such as carbon tetrachloride and perchloroethylene.

As the commercial products of the petroleum-type aliphatic hydrocarbon that can be employed in the present invention, there are Isopar E, Isopar G, Isopar L, Isopar H, Isopar K, Naphtha No. 6 and Solvesso 100, which are produced by Exxon Chemical Co., Ltd. These can be used alone or in combination.

Conventionally a flushing method is known, in which, for instance, an aqueous dispersion of carbon black is kneaded together with a resin solution, so that the water which covers the carbon black is replaced by the resin solution, and then a colorant is prepared by removing the water and the solvent. Even in this flushing method, since carbon black is not hydrophilic, it is not dispersed well in water and therefore cannot be dispersed therein in the form of finely-divided particles. Consequently, it is extremely difficult to disperse carbon black in the primary particle size. Therefore, in the case where a colorant, which is prepared by the conventional flushing method, without using the ionomer resin is used as toner particles in a liquid developer for electrophotography, images with high image density, excellent image gradation and image fixing performance, are difficult to form because of its poor dispersion in the carrier liquid.

Nevertheless, in order to improve the method of producing colorants by use of the flushing method, there are known (i) a method of adding anionic, nonionic or cationic surfactants, or a polymer dispersing agent for synthesis of polymer, when a pigment such as carbon black is dispersed in water, and (ii) a method of dispersing a pigment such as carbon black by the use of the humic acid component, and kneading a low-molecular weight polyethylene, natural resin-modified resin, dammar, copal, shellac, gum rosin, styrene-butadiene copolymer, and polyolefin, and coating the pigment particles with the kneaded resin, which is disclosed in Japanese Laid-Open Patent Application No. 59-102253. However, the colorant prepared by the first method has the drawback that the dispersion of the colorant in the carrier liquid is insufficient, while the colorant prepared by the second method has the drawbacks that the colorant is poor in the compatibility and blending performance with other resins, accordingly the fixing property thereof is inferior to other colorants.

Preparation of colorants and examples of a developer according to the present invention will now be explained. These examples are given for illustration of the present invention and are not intended to be limiting thereof.

COLORANT PREPARATION EXAMPLE 1

A mixture of the following components was stirred well in a flusher:

| | |
|---|---|
| water | 500 g |
| carbon black (Conductex SC) | 200 g |
| humic acid | 10 g |

To the above mixture, 600 g of an ionomer resin (Himilan 1554) and 600 g of toluene were added, and the mixture was kneaded. The kneaded mixture was then heated under reduced pressure to remove water and the solvent (toluene), whereby a lump of a colorant with a content of volatile components being 0.50% was obtained. The thus obtained colorant was ground in a stone mill, whereby finely-divided particles of the colorant having a particle size of 1~5 μm (hereinafter referred to Colorant No. 1) were obtained.

COLORANT PREPARATION EXAMPLES 2~12

Colorant Preparation Example 1 was repeated except that the formulation in Colorant Preparation Example 1 was replaced by the respective formulations in Table 1, whereby six different finely-divided colorants having a particle size of 1~5 μm (hereinafter respectively referred to as Colorants No. 2 to No. 7) were prepared.

By merely mixing the respective components in Table 2, without employing the flushing method, five different finely-divided colorants having a particle size of 1~5 μm (hereinafter respectively referred to as Colorants No. 8 and No. 12) were obtained.

TABLE 1

| Colorant Preparation Examples | Pigments | Ionomer Resins | Humic Acid Component | Other Components | |
|---|---|---|---|---|---|
| 2 | Regal 400 | Himilan 1557 | Nitrohumic Acid | Rosin-modified maleic acid resin | 10 g |
| | | | | Toluene | 500 g |
| 3 | Tri-iron tetroxide | Himilan 1856 | Nitrohumic acid | — | |
| 4 | Mogal A | Himilan 1650 | Aluminum Huminate | Epolene E-15 | 50 g |
| | | | | Isopar H | 500 g |
| 5 | Alkali Blue | (1) Ethylene-methacrylic acid ionomer resin | Aluminum Huminate | — | |
| 6 | Phthalocyanine Blue | (3) Propylene-acrylic acid diethylaminoethyl methacrylate ionomer resin | — | — | |
| 7 | MA-100 | (5) Ethylene-propylene-lauryl methacrylate- | Sodium Huminate | Viscol 66 | 30 g |
| | | | | n-hexane | 600 g |

TABLE 1-continued

| Colorant Preparation Examples | Pigments | Ionomer Resins | Humic Acid Component | Other Components |
|---|---|---|---|---|
| | | acrylic acid ionomer resin | | |

TABLE 2

| Colorant Preparation Examples | Pigments | Ionomer Resins | Humic Acid Component | Other Components |
|---|---|---|---|---|
| 8 | Special Black 4 200 g | Himilan 1555 600 g | — | AC Polyethylene 40 g |
| 9 | Mogal L 200 g | Himilan 1856 600 g | — | — |
| 10 | Phthalocyanine Green 200 g | (2) Ethylene-methyl methacrylate-methacrylic acid ionomer resin | — | — |
| 11 | Regal 400 200 g | (4) Propylene-isobutyl methacrylate-glycidyl methacrylate-maleic acid ionomer resin | — | Sanwax 171P 50 g |
| 12 | Alkali Blue 200 g | (5) Ethylene-propylene-lauryl methacrylate acrylic acid ionomer resin | — | — |

EXAMPLES 1~12

20 g of the finely-divided particles of the colorant prepared in Colorant Preparation Examples 1 through 12 and 50 g of lauryl acrylate-acrylic acid copolymer resin (polymerization molar ratio 90:10) were added to 100 g of Isopar G. This mixture was kneaded in a ball mill for 72 hours, whereby a concentrate toner was prepared.

50 g of the thus prepared concentrate toner was dispersed in a 2 l of Isopar H, whereby liquid developers No. 1 through No. 12 according to the present invention were prepared.

By use of each of the above prepared liquid developers No. 1 through No. 12 in a commercially available electrophotographic copying machine (Trademark "Ricopy DT-1200" made by Ricoh Company, Ltd.), copies were made. The image density, resolution and image fixing performance obtained by each of the developers are shown in Table 3.

EXAMPLES 13~15

Each lump of the colorants obtained in Colorant Preparation Examples 1, 2 and 3 was ground to finely-divided colorant particles having a particle size of 10 μm to 15 μm, whereby dry-type toners No. 13 through No. 15 according to the present invention were prepared.

By use of each of the above prepared dry-type toners No. 13 to No. 15 in a commercially available electrophotographic copying machine (Trademark "Ricopy FT-6040" made by Ricoh Company, Ltd.), copies were made. The image density, resolution and image fixing performance obtained by each of the developers are shown in Table 3.

TABLE 3

| Examples | I.D. | Resolution | Image Fixing Performance (%) |
|---|---|---|---|
| 1 | 1.48 | 6.3 | 88 |
| 2 | 1.48 | 7.0 | 86 |
| 3 | 1.35 | 6.3 | 89 |
| 4 | 1.50 | 6.3 | 90 |
| 5 | 1.30 | 7.0 | 90 |
| 6 | 1.40 | 5.6 | 88 |
| 7 | 1.50 | 6.3 | 88 |
| 8 | 1.50 | 4.2 | 84 |
| 9 | 1.48 | 5.3 | 83 |
| 10 | 1.33 | 5.3 | 83 |
| 11 | 1.50 | 4.2 | 82 |
| 12 | 1.22 | 5.3 | 80 |
| 13 | 1.52 | 4.2 | 85 |
| 14 | 1.50 | 5.3 | 90 |
| 15 | 1.30 | 5.3 | 86 |

I.D.: Image Density

What is claimed is:

1. A developer for electrophotography comprising toner particles which comprise a colorant prepared by a flushing method by using at least a pigment component and an ionomer resin.

2. A developer as claimed in claim 1 in which said toner particles have been prepared by kneading an aqueous dispersion of particles of said pigment with a solution of said ionomer resin in an organic solvent so that the pigment particles are covered by said resin solution and then removing the water and said solvent to obtain said colorant.

3. The developer for electrophotography as claimed in claim 1, wherein said toner particles comprise a humic acid component selected from the group consisting of humic acid, a salt of humic acid, and a humic acid derivative.

4. The developer for electrophotography as claimed in claim 1, wherein said ionomer resin has a structure of the formula:

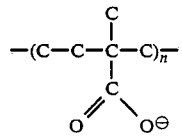

-continued

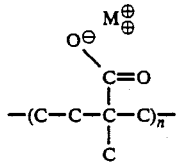

Wherein M represents a monovalent or divalent metallic element.

5. The developer for electrophotography as claimed in claim 1, wherein said ionomer resin is selected from the group consisting of:

(1) Ethylene-methacrylic acid ionomer resin (mole ratio 90:10, metal: Na)

(2) Ethylene-methyl methacrylate-methacrylic acid ionomer resin (mole ratio 70:10:20, metal: Zn)

(3) Propylene-acrylic acid-diethylaminoethyl methacrylate ionomer resin (mole ratio 70:25:5, metal: Mg)

(4) Propylene-isobutyl methacrylate-glycidyl methacrylate-maleic acid ionomer resin (mole ratio 50:20:15:15, metal: Fe)

(5) Ethylene-propylene-lauryl methacrylate-acrylic acid ionomer resin (mole ratio 30:30:20:20, metal: Zr or Ca).

6. The developer for electrophotography as claimed in claim 1, wherein said pigment component is selected from the group consisting of carbon black and organic pigments.

7. A developer for electrophotography in which the toner particles consist essentially of pigment particles coated with an ionomer resin, said toner particles having been prepared by a flushing method, said toner particles containing from 1 to 10 parts by weight of said ionomer resin per 1 part by weight of said pigment.

8. A developer for electrophotography in which the toner particles consist essentially of pigment particles, a humic acid component selected from the group consisting of humic acid, salts of humic acid and derivatives of humic acid and an ionomer resin coating on said pigment particles, said toner particles having been prepared by a flushing method, said toner particles containing from 1 to 10 parts by weight of said ionomer resin per 1 part by weight of said pigment.

9. The developer for electrophotography as claimed in claim 7 in which said ionomer resin is crosslinked by metal ions selected from the group consisting of Zn, Na, K, Fe, Al, Co, Zr, Ca, Mg, Ni and Sn.

10. The developer for electrophotography as claimed in claim 8 in which said ionomer resin is crosslinked by metal ions selected from the group consisting of Zn, Na, K, Fe, Al, Co, Zr, Ca, Mg, Ni and Sn.

11. A developer for electrophotography as claimed in claim 7 in which said toner particles are free of an inorganic metal salt.

12. A developer for electrophotography as claimed in claim 8 in which said toner particles are free of an inorganic metal salt.

* * * * *